US009328706B2

(12) United States Patent
Serizawa et al.

(10) Patent No.: US 9,328,706 B2
(45) Date of Patent: May 3, 2016

(54) FUEL INJECTOR

(71) Applicant: DENSO CORPORATION, Kariya, Aichi-pref. (JP)

(72) Inventors: Kazufumi Serizawa, Obu (JP); Atsushi Utsunomiya, Kitanagoya (JP); Fumihiro Fujikake, Anjo (JP); Fumiaki Arikawa, Okazaki (JP); Yuuta Hashimoto, Nishio (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/625,939

(22) Filed: Feb. 19, 2015

(65) Prior Publication Data

US 2015/0247478 A1 Sep. 3, 2015

(30) Foreign Application Priority Data

Feb. 28, 2014 (JP) ..... 2014-38468

(51) Int. Cl.

| | |
|---|---|
| ***B05B 1/30*** | (2006.01) |
| ***F02M 51/06*** | (2006.01) |
| ***F02M 61/04*** | (2006.01) |
| ***F02M 61/18*** | (2006.01) |

(52) U.S. Cl.

CPC ..... *F02M 51/061* (2013.01); *F02M 61/04* (2013.01); *F02M 61/18* (2013.01)

(58) Field of Classification Search

CPC ..... F02M 51/0603; F02M 51/005; F02M 51/0625; F02M 61/10; F02M 61/168; F02M 61/188

USPC ..... 239/585.1, 585.3, 585.4, 585.5, 533.12

See application file for complete search history.

(56) References Cited

U.S. PATENT DOCUMENTS

| | | | | |
|---|---|---|---|---|
| 5,873,526 | A * | 2/1999 | Cooke | F02M 47/027 239/533.5 |
| 6,354,520 | B1 * | 3/2002 | Yalcin | F02M 61/10 239/533.11 |
| 6,626,371 | B1 * | 9/2003 | Boecking | F02M 47/027 239/533.2 |
| 7,191,963 | B2 * | 3/2007 | Cobianchi | F02M 47/027 239/585.1 |
| 7,891,586 | B2 * | 2/2011 | Ganser | F02M 47/027 123/456 |
| 2006/0226263 | A1 | 10/2006 | Holzgrefe et al. | |
| 2009/0242668 | A1 | 10/2009 | Higuma et al. | |
| 2010/0282872 | A1 | 11/2010 | Krause | |

FOREIGN PATENT DOCUMENTS

| | | |
|---|---|---|
| GB | 1 088 666 | 10/1967 |
| JP | 2000-314360 | 11/2000 |
| JP | 2001-214839 | 8/2001 |
| JP | 4306656 | 5/2009 |

* cited by examiner

*Primary Examiner* — Davis Hwu
(74) *Attorney, Agent, or Firm* — Nixon & Vanderhye PC

(57) ABSTRACT

A fuel injector has a cylindrical nozzle body, a nozzle needle, a pressure chamber and an injection passage. The injection passage includes a first hole and a second hole. A minimum vertical distance between an outer periphery of a first nozzle hole outlet and a contact point relative to an axial center line of the first hole is defined as a vertical distance R. A minimum axial distance between the first nozzle hole outlet and the contact point relative to an axial center line of the first hole is defined as an axial distance L. An angle between the axial center line of the first nozzle hole and the outer periphery line of the fuel spray is defined as an injection angle θ. The vertical distance R, the axial distance L and the injection angle θ satisfy a formula: $R/(L \times \tan\theta) > 6.0$.

7 Claims, 5 Drawing Sheets

| | | | Test1 | | Test2 | | Test3 | | Test4 | |
|---|---|---|---|---|---|---|---|---|---|---|
| INSECTOR | R (mm) | L (mm) | θ | X | θ | X | θ | X | θ | X |
| A | 0.2 | 0.2 | 5.6 | 6.0 | 7.5 | 7.6 | 5.3 | 10.8 | 6.2 | 10.8 |
| B | 0.19 | 0.25 | 9.8 | 4.7 | 8.2 | 5.3 | 5.9 | 7.4 | 7.3 | 7.4 |
| C | 0.2 | 0.15 | 8.3 | 9.1 | 6.7 | 12.2 | 6.2 | 13.1 | 7.2 | 13.1 |
| D | 0.2 | 0.1 | 6.5 | 18.3 | 6.4 | 20.0 | 5.4 | 23.7 | 5.9 | 23.7 |
| E | 0.22 | 0.2 | 4.3 | 15.1 | 3.1 | 21.2 | 18.9 | 3.3 | - | - |
| F | 0.15 | 0.2 | 3.5 | 12.2 | 6.4 | 6.7 | 19.1 | 2.2 | - | - |
| G | 0.22 | 0.3 | 8.9 | 4.6 | 9.1 | 4.5 | 8.9 | 4.6 | 8.1 | 5.0 |
| H | 0.21 | 0.3 | 9.0 | 4.4 | 9.3 | 4.3 | 12.7 | 3.1 | 8.5 | 4.7 |

FUEL INJECTOR

CROSS-REFERENCE TO RELATED APPLICATION

This application is based on Japanese Patent Application No. 2014-38468 filed on Feb. 28, 2014, the disclosure of which is incorporated herein by reference.

TECHNICAL FIELD

The present disclosure relates to a fuel injector that injects a fuel into a cylinder of an internal combustion engine.

BACKGROUND

JP2006-510849A (U.S.2006-0226263A1, DE10325289A1, CN1798920A) discloses a fuel injector, in particular for a direct injection of fuel into a combustion chamber of an internal combustion engine. The fuel injector has a valve-closure member which cooperates with a valve-seat surface formed on a valve-seat body, to form a sealing seat. The fuel injector includes at least one spray-discharge orifice provided downstream from the sealing seat. The spray-discharge orifice has a guide region and an exit region arranged at its discharge-side end. The exit region widens in a stepped manner by at least one first step and/or at least in part continuously beginning with a transition from the guide region into the exit region. A fuel jet which emerges from the guide region at the transition and widens essentially uniformly at a jet angle, passes a discharge-side end of the exit region with a gap dimension of a gap after a distance. The gap dimension is greater than zero and a first volume remaining in the exit region between the fuel jet and the inner walls of the exit region.

In the conventional fuel injector, when a pressure of a fuel spray is lower than a specified value, the fuel spray is formed to suppress a caulking. However, when a pressure of a fuel spray is higher than the specified value, the fuel spray is attracted to an inner wall surface of the injector body. The fuel may adhere to the inner wall surface.

SUMMARY

It is an object of the present disclosure to provide a fuel injector capable of suppressing a caulking and an instability of a fuel spray shape.

According to the present disclosure, a fuel injector has a cylindrical nozzle body, a nozzle needle axially moving in the cylindrical nozzle body, a pressure chamber defined between the nozzle needle and the cylindrical nozzle body for receiving a fuel therein, and an injection passage defined in the nozzle body to fluidly connect the pressure chamber and a cylinder of an internal combustion engine. The fuel in the pressure chamber is injected into the cylinder as a fuel spray. The injection passage has a first hole which is opened to the pressure chamber and a second hole which is opened to the cylinder. An inner diameter of the second hole is larger than an inner diameter of the first hole. An outer periphery line of the fuel spray agrees with an inner wall of the second hole at a contact point. A minimum vertical distance between an outer periphery of a first nozzle hole outlet and the contact point relative to an axial center line of the first hole is defined as a vertical distance R. A minimum axial distance between the first nozzle hole outlet and the contact point relative to an axial center line of the first hole is defined as an axial distance L. An angle between the axial center line of the first nozzle hole and the outer periphery line of the fuel spray is defined as an injection angle θ. The vertical distance R, the axial distance L and the injection angle θ satisfy a formula: $R/(L \times \tan\theta) > 6.0$.

According to the present disclosure, a caulking and an instability of a fuel spray can be suppressed.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
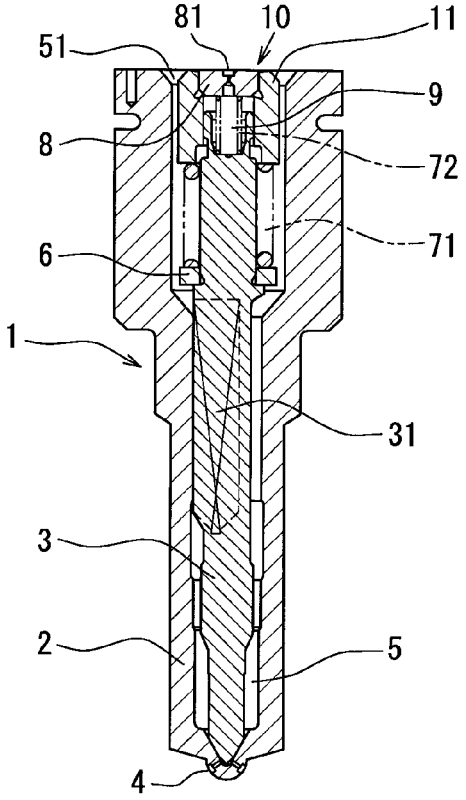
FIG. 1 is a longitudinal-sectional view showing a fuel injector according to a first embodiment.

Hereafter, embodiments of the present disclosure will be described hereinafter. In each embodiment, the same parts and the components are indicated with the same reference numeral and the same description will not be reiterated.

First Embodiment

Referring to FIG. 1 to FIG. 4, a fuel injector 1 of the first embodiment will be explained, hereinafter.

The fuel injector 1 has a nozzle body 2, a nozzle needle 3, and a pressure control portion 10. The pressure control portion 10 controls a pressure in a pressure chamber 5 defined between the nozzle body 2 and the nozzle needle 3, whereby the nozzle needle 3 moves up and down.

The nozzle body 2 is cylindrically shaped and is made of ferrous materials. The nozzle body 2 defines a space therein. The nozzle needle 3 is accommodated in the space. The pressure chamber 5 is defined between the nozzle needle 3 and the nozzle body 2. The pressure control portion is arranged at a base end of the nozzle body 2. A sack portion 21 is formed at a tip end of the nozzle body 2. The sack portion 21 has an injection passage 4 which communicates the pressure chamber 5 and a combustion chamber (not shown) of an internal combustion engine. The nozzle body 2 has a seat portion 21 with which the nozzle needle 3 is brought into contact.

The nozzle needle 3 is a column which has three recesses 31 on its outer surface. Each of the recesses 31 extends in an axial direction of the nozzle needle 3. The fuel flows from the bottom end to the tip end of the nozzle body 2 through the recesses 31. The nozzle needle 3 has an annular shim 6. A cylinder 11 of the pressure control portion 10 is provided to the base end of the nozzle needle 3. A first spring 71 is disposed between the shim 6 and the cylinder in such a manner as to bias the nozzle needle 3 toward its tip end.

The pressure control portion 10 includes the cylinder 11, an orifice plate 8 and a second spring 72. The base end of the nozzle needle 3 and the orifice plate 8 are arranged inside of the cylinder 11. The orifice plate 8 has an orifice 81. The orifice 81 communicates with a fuel passage extending from a common-rail (not shown). A fuel quantity passing through the orifice 81 is adjusted by an electromagnetic valve provided in the fuel passage.

The second spring 72 is disposed between the orifice plate 8 and the nozzle needle 3. The second spring 72 biases the orifice plate 8 toward the base end of the nozzle body 2. Moreover, a control chamber 9 is defined between the cylinder 11, the orifice plate 8 and the nozzle needle 3. The fuel is introduced into the control chamber 9 through the orifice 81. The pressure in the control chamber 9 is controlled by adjusting the fuel quantity by the electromagnetic valve.

When the fuel is less introduced into the control chamber 9, the pressure in the control chamber 9 is decreased. The nozzle needle 3 receives a fuel pressure in the pressure chamber 5, whereby the nozzle needle 3 moves apart from the seat portion 21. Meanwhile, when the fuel flows into the control chamber 9, the pressure in the control chamber 9 is increased. The nozzle needle 3 receives the fuel pressure in the pressure chamber 5 and the fuel pressure in the control chamber 9, which are substantially equal to each other. The nozzle needle 3 receives the biasing force from the first spring 71 and the second spring 72, so that the nozzle needle 3 is brought into contact with the seat portion 21. As above, an axial position of the nozzle needle 3 is controlled by the pressure control portion 10. According to the position of the nozzle needle 3, the pressure chamber 5 and the injection passage 4 are fluidly connected or disconnected with each other.

The pressure chamber 5 is formed between the nozzle body 2 and the nozzle needle 3. The pressure chamber 5 communicates with an interior of the sack portion 21. The fuel flows into the pressure chamber 5 from the fuel-passage-inlet 51. The fuel-passage-inlet 51 is fluidly connected with the common-rail (not shown). The supplied fuel flows from the fuel-passage-inlet 51 toward the pressure chamber 5 through the recesses 31. When the nozzle needle 3 moves apart from the seat portion 21, the fuel flows into the interior of the sack portion 21. Then, the fuel is injected into the combustion chamber through the injection passage 4.

Figure 2:
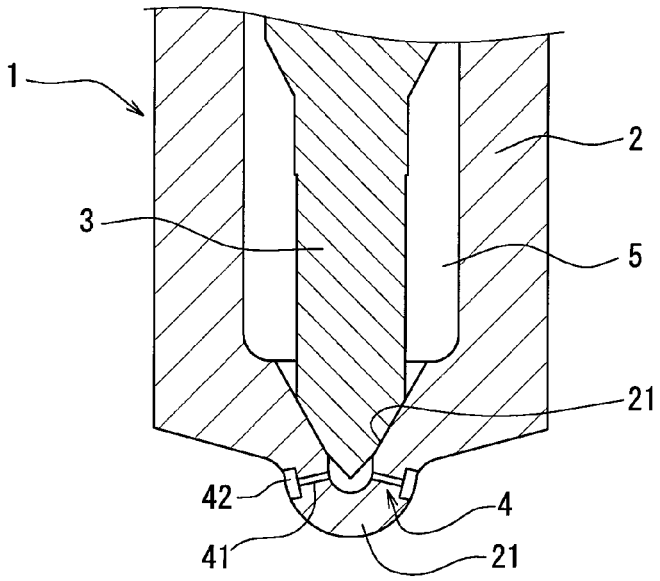
FIG. 2 is an enlarged sectional view showing a tip end portion of the fuel injector according to the first embodiment.
Figures 3, 4:
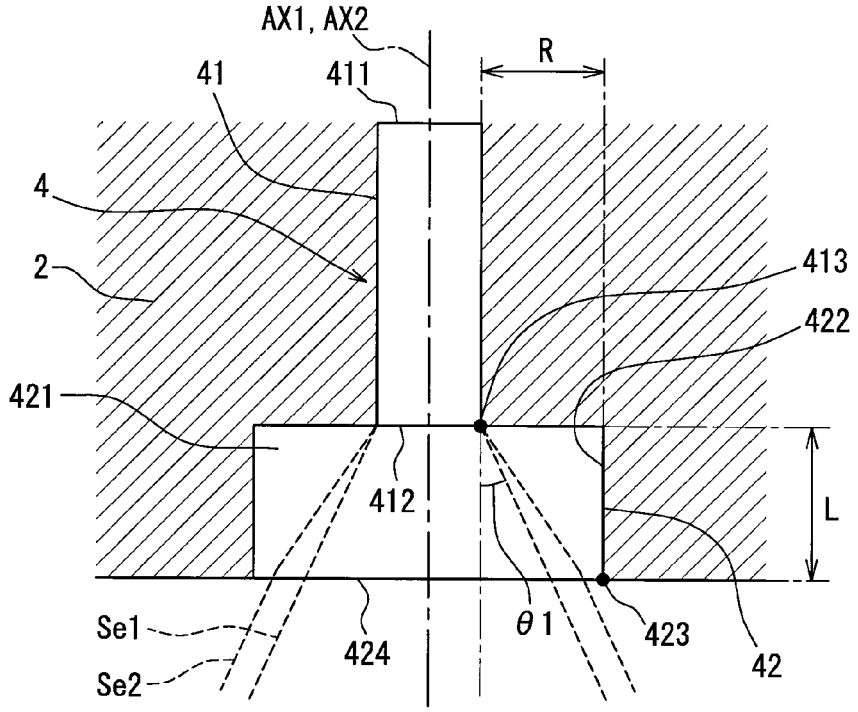
FIG. 3 is an enlarged sectional view schematically showing an injection passage according to the first embodiment.
FIG. 4 is a diagram showing experimental results.

Referring to FIGS. 2 and 3, the configuration of the injection passage 4 will be described in detail. FIG. 3 is a schematic chart explaining the injection passage 4. The nozzle body 2 has a plurality of injection passages 4 at its tip end. The injection passages 4 are arranged at regular intervals around a center line of the nozzle body 2. Thus, the fuel in the sack portion 21 can be injected into the combustion chamber uniformly. Each of the injection passages 4 is formed independently mutually. That is, each injection passage 4 does not interfere with other injection passages 4.

The injection passage 4 is configured by a counterbore 42 and a nozzle hole 41. The counterbore 42 is a circular concaved portion formed on the outer surface of the sack portion 21. A diameter of the counterbore 42 is larger than that of the nozzle hole 41. Thus, a stepped surface is formed in the injection passage 4 between the counterbore 42 and the nozzle hole 41. One end of the nozzle hole 41 is opened to the interior of the sack portion 21 and the other end of the nozzle hole 41 is opened to the counterbore 42. The counterbore 42 and the interior of the sack portion 21 are fluidly connected with each other through the nozzle hole 41. The nozzle hole 41 has a circular cross section. Moreover, an axial center line AX2 of the counterbore 42 and an axial center line AX1 of the nozzle hole 41 are coincide with each other. The diameter of the nozzle hole 41 is smaller than that of the counterbore 42. The nozzle hole 41 corresponds to a first hole and the counterbore 42 corresponds to a second hole.

The nozzle hole 41 has a constant diameter from a nozzle hole inlet 411 to a nozzle hole outlet 412. The fuel can flow in the nozzle hole 41 smoothly.

The fuel passed through the nozzle hole 41 is spread in the counterbore 42 by its own pressure. The spread fuel is referred to a fuel spray, hereinafter.

The fuel spray has a specified injection angle θ1 in the counterbore 42. As shown in FIG. 3, the injection angle is defined between the axial center line AX2 of the nozzle hole 41 and an outer periphery line Se1 of the fuel spray. The injection angle θ1 varies according to an injection pressure and an axial length of the nozzle hole 41. As the injection angle θ1 becomes larger, the outer periphery line Se1 of the fuel spray comes more close to an inner wall 422 of the counterbore 42. When the fuel spray is most spread, the outer periphery line Se1 of the fuel spray agrees with the inner wall 422 of the counterbore 42 at a contact point 423.

A vertical distance "R" relative to the axial center line AX1 is a minimum distance between an outer periphery 413 of the nozzle hole outlet 412 and the contact point 423. An axial distance "L" relative to the axial center line AX1 is a minimum distance between the nozzle hole outlet 412 and the contact point 423. The nozzle hole 41 and the counterbore 42 are formed in such a manner as to satisfy a following formula: $R/(L \times \tan \theta 1) > 6.0$ Especially, regarding the fuel injector 1 for a diesel engine, the fuel is pressurized to 25 Mpa-250 Mpa, whereby the injection angle θ1 tends to become larger. According to the present embodiment, even if the fuel is injected under the pressure of 25 MPa-250 Mpa, the above formula is satisfied.

Referring to FIG. 3, an advantage and an operation of the fuel injector 1 of the first embodiment will be explained, hereinafter.

Generally, as the fuel injection pressure becomes higher, a spreading force of the fuel spray becomes greater. Thus, the injection angle θ1 also becomes larger. A distance between the outer periphery line Se1 and the contact point 423 become shorter.

When the distance between the outer periphery line Se1 and the contact point 423 becomes short, the Coanda effect is generated between the fuel spray and the inner wall 422 of the counterbore 42. The fuel spray is attracted toward the inner wall 422 due to the Coanda effect. The shape of the fuel spray is changed. FIG. 3 shows an outer periphery line Se2 of the fuel spray. As a distance between the outer periphery line Se1 and the contact point 423 becomes shorter, the Coanda effect is more generated. The fuel spray is more attracted toward the contact point 423. Since the diameter of the injection passage 4 is extremely small, the outer periphery line Se1 is attracted to the contact point 423 due to the Coanda effect.

The Coanda effect may cause following phenomena. The fuel spray is attracted toward the inner wall 422 of the counterbore 42 and a part of the fuel spray remains in the counterbore 42. The fuel spray is easily brought into contact with the inner wall 422 of the counterbore 42. The counterbore 42 has a space 421 through which no fuel spray passes. A swirl of the fuel is generated in the space 421. The swirl makes the remaining fuel spray flow out. When the remaining fuel quantity becomes larger than the flowing-out fuel quantity, a part of the fuel continues to remain in the space 421. The fuel may adhere to the injection passage 4, which is referred to as a caulking. When the fuel spray is attracted toward the inner wall 422 due to the Coanda effect, the shape of the fuel spray will be changed. A penetration force and an infusibility of the fuel spray changes in the combustion chamber.

In view of the above phenomena, the present inventors have found out that specific dimensions of the injection passage 4 can effectively restrict the Coanda effect. When the ratio R/L becomes less than a specified value, the Coanda effect is generated. Thus, according to the present embodiment, the ratio R/L is larger than the specified value in order to restrict the Coanda effect. A caulking in the injection passage 4 can be suppressed. An instability of a fuel-spray shape can be suppressed.

Figure 5:
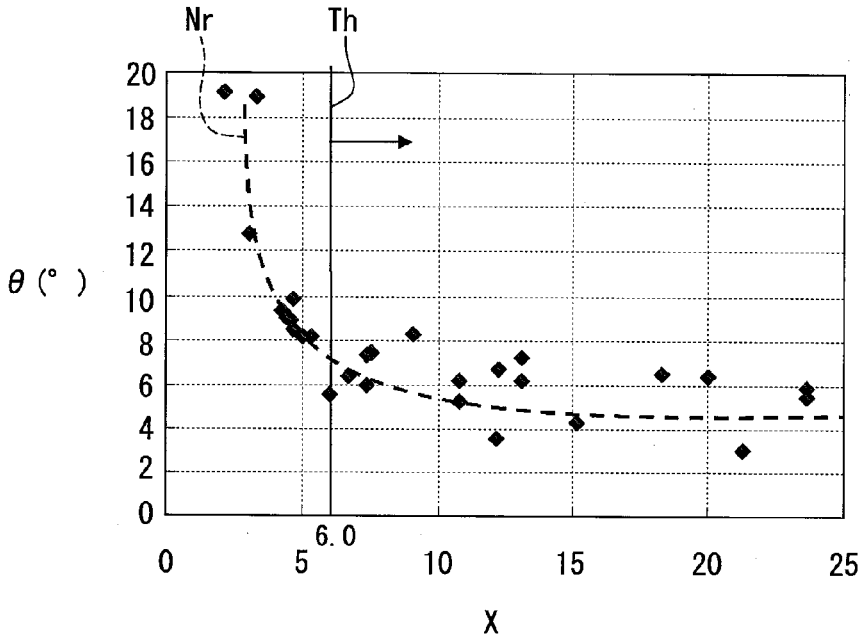
FIG. 5 is a graph showing a correlation between an injection angle θ and a characteristic value X.

FIGS. 4 and 5 are diagrams showing results of experiments for explaining effects of the present embodiment. The experiments are conducted with respect to fuel injectors "A" to "H" having the injection passage 4 and the counterbore 42 respectively. The fuel injection pressure Pr is varied from 25 Mpa to 250 Mpa. Regarding each one of the fuel injectors "A" to "H", four experiments "Test1" to "Test 4" are conducted. As shown in FIG. 5, each of the fuel injectors "A" to "H" has its own distances "R" and "L". In each experiment, the injection angle θ is measured to compute "R/L×tan θ". The value of the "R/L×tan θ" is referred to as a characteristic value X, hereinafter. The experiments "Test1" to "Test4" are conducted in this order. In the experiment "Test1", the fuel injection pressure Pr is lowest among the experiments. The fuel injection pressure Pr is increased along with the order of experiments "Test1" to "Test4". That is, in the experiment "Test4", the fuel injection pressure Pr is highest among the experiments.

As the fuel injection pressure Pr is higher, the injection angle θ becomes larger. However, the injection angle θ in "Test3" is smaller than that in "Test2" with respect to the fuel injectors "A", "B", "D", and "G". With respect to the fuel injectors "A", "C" and "D", there is no caulking in each experiment "Test1" to "Test4". On the other hand, with respect to the fuel injectors "G" and "H", there is a caulking in each experiment "Test1" to "Test4". With respect to the fuel injector "B", there is no caulking in "Test3" and "Test4", however, there is a caulking in "Test1" and "Test2". With respect to the fuel injectors "E" and "F", there is no caulking in "Test1" and "Test2", however, there is a caulking in "Test3".

Based on the experimental results shown in FIG. 4, a correlation between the injection angle θ and the characteristic value X is obtained. FIG. 5 shows an approximate line Nr. When the characteristic value X is smaller than a specified value, the injection angle θ becomes large. When the characteristic value X is greater than the specified value, the injection angle θ does not become large. It is considered that the fuel spray is not attracted toward the inner wall 422 of the counterbore 42 and the Coanda effect is restricted. According to the experimental results, when the characteristic value X is greater than or equal to a threshold "Th", the Coanda effect is restricted. That is, when characteristic value X is greater than or equal to 6.0, the Coanda effect is restricted, whereby the caulking can be suppressed without making the injection angle θ large. The injection angle θ is converged to a specified angle. The shape of the fuel spray can be stabilized.

As above, the fuel injector is configured so that the characteristic value X is greater than or equal to 6.0. The Coanda effect can be suppressed. It can be avoided that the fuel adheres to the inner wall 422 of a counterbore 42. The injection angle does not vary significantly. Thus, a caulking in the injection passage can be suppressed and an instability of a fuel-spray shape can be suppressed.

According to the present embodiment, the fuel injector 1 has the injection passage 4 which satisfies the above described formula: $R/(L\times\tan\theta\mathbf{1})>6.0$ Even if the fuel pressure is high, it is restricted that the fuel spray is attracted to the inner wall 422 of the counterbore 42. A caulking can be suppressed effectively. The fuel spray shape is stabilized and a combustion can be conducted effectively.

Furthermore, in the present embodiment, a plurality of injection passages 4 is formed in the nozzle body 2. The counterbore 42 of each injection passage 4 is formed so that the injection passages 4 are not fluidly connected to each other. That is, each injection passage 4 does not interfere with other injection passages 4. Thereby, it can be suppressed that the mechanical strength of the nozzle body 2 is decreased due to the counterbores 42. Moreover, since each injection passage 4 does not interfere with other injection passages 4, it can be suppressed that the fuel spray collides with each other. The shape of the fuel spray is not disturbed.

Furthermore, in the present embodiment, the diameter of the nozzle hole inlet 411 is equal to the diameter of the nozzle hole outlet 412. The flow velocity of the fuel in the injection passage 4 is increased. For this reason, the fuel flow in the injection passage 4 may become a turbulent flow. However, according to the present embodiment, since the inner diameter of the nozzle hole 41 is constant, the fuel flow in the nozzle hole 41 becomes the laminar flow. The shape of the fuel spray can be stable.

The axial center line AX1 of the counterbore 42 and the axial center line AX2 of the nozzle hole 41 are coincide with each other. Thus, the counterbore 42 can be easily formed to satisfy the above formula.

Second Embodiment

Figure 6:
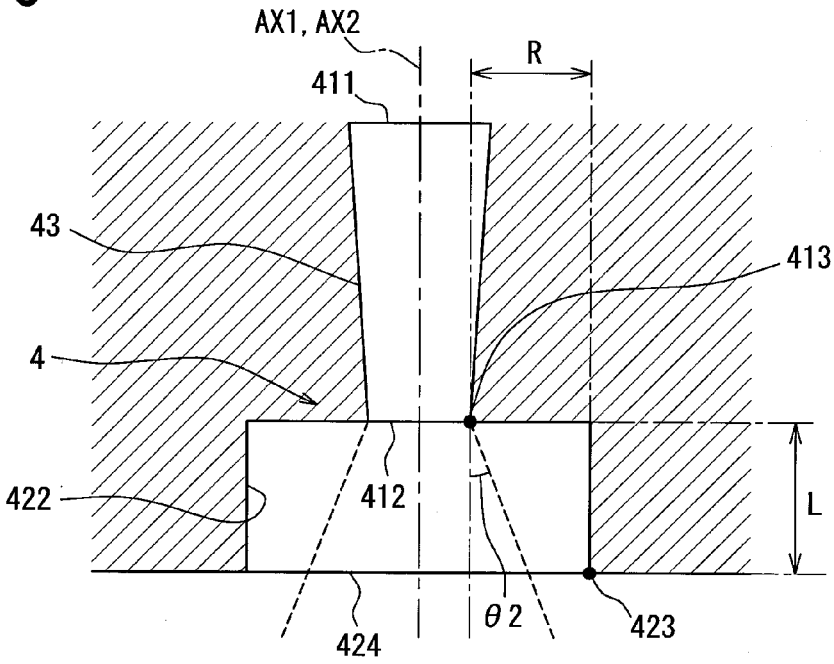
FIG. 6 is an enlarged sectional view schematically showing an injection passage according to a second embodiment.

A second embodiment will be described hereinafter. In the second embodiment, as shown in FIG. 6, the configuration of the nozzle hole 43 is different from the first embodiment. FIG. 6 is a schematic chart explaining the injection passage 4.

An inner diameter of the nozzle hole inlet 411 is greater than that of the nozzle hole outlet 412. The inner diameter of the nozzle hole 43 is gradually decreased from the nozzle hole inlet 411 toward the nozzle hole outlet 412. The vertical distance "R", the axial distance "L", the injection angle θ2 are defined as to satisfy the following formula: $R/(L\times\tan\theta\mathbf{2})>6$.

A caulking in the injection passage 4 can be suppressed. An instability of a fuel-spray shape can be suppressed.

Moreover, since the inner diameter of the nozzle hole 43 is gradually decreased from the nozzle hole inlet 411 toward the nozzle hole outlet 412, the flow velocity of the fuel is increased in the injection passage 4. Thereby, the penetration force of the fuel spray is increased.

Third Embodiment

Figure 7:
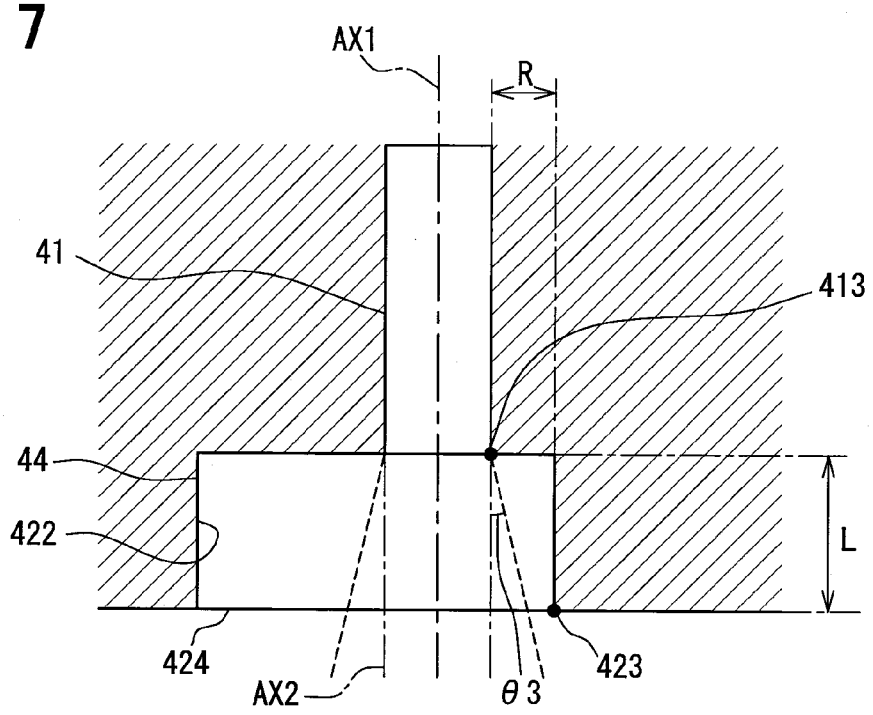
FIG. 7 is an enlarged sectional view schematically showing an injection passage according to a third embodiment.

A third embodiment will be described hereinafter. In the third embodiment, as shown in FIG. 7, the configuration of the counterbore 44 is different from the first embodiment. FIG. 7 is a schematic chart explaining the injection passage 4.

An axial center line AX2 of the counterbore 44 deviates from an axial center line AX1 of the nozzle hole 44. Since the center line of the fuel spray deviates from the center line of the counterbore 44, the outer diameter of the fuel spray is different from the inner diameter of the counterbore 44. The contact point 423 exists on the inner wall 422 of a counterbore 44. A caulking in the injection passage 4 can be suppressed and an instability of a fuel-spray shape can be suppressed.

Other Embodiments

Figure 8:
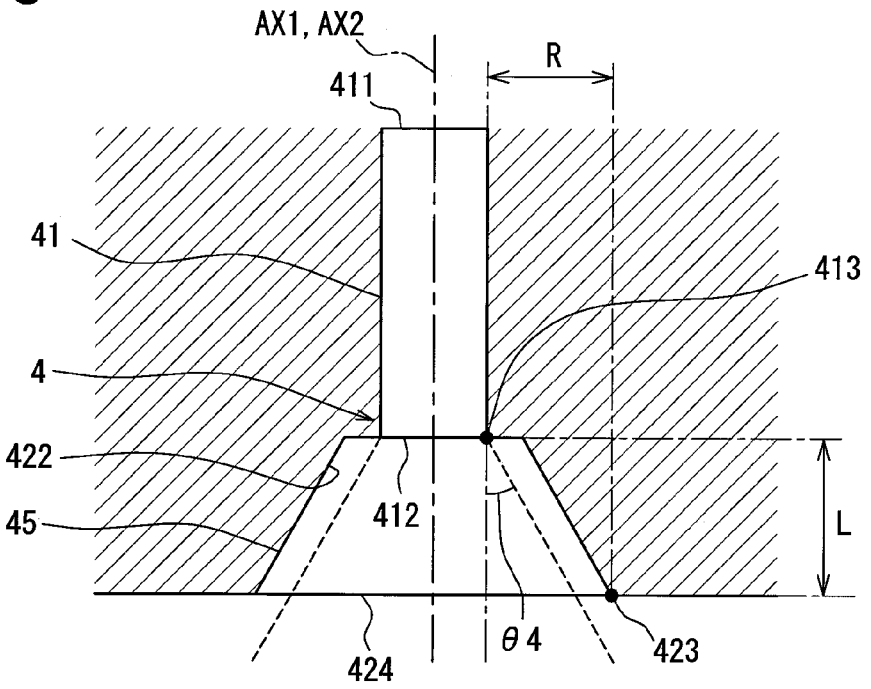
FIG. 8 is an enlarged sectional view schematically showing an injection passage according to a first modification.
Figure 9:
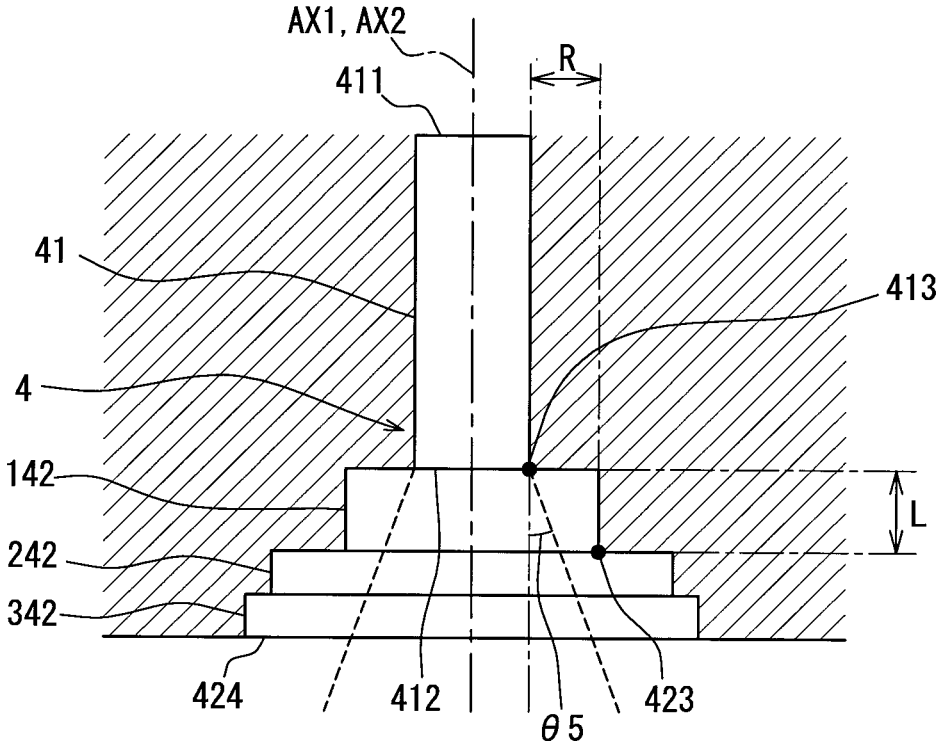
FIG. 9 is an enlarged sectional view schematically showing an injection passage according to a second modification.

The present disclosure should not be limited to the above embodiments, but may be implemented in other ways without departing from the spirit of the disclosure. FIGS. 8 and 9 are schematic charts explaining the injection passage 4.

FIG. 8 shows a first modification in which the inner diameter of the inner wall 422 gradually increases toward the outlet of the injection passage 4. The injection passage 4 is configures to satisfy the formula: $R/(L\times\tan\theta\mathbf{4})>6.0$ FIG. 9 shows a second modification in which the injection passage 4 has three counterbores 142, 242, 342 of which inner diameter is different from each other. The contact point 423 exists between a first counterbore 142 and the second counterbore 242.

The first counterbore 142 is configured to satisfy the following formula: $R/(L\times\tan\theta\mathbf{5})>6.0$ Furthermore, according to a third modification, any one of the nozzle hole 41 and the counterbore 42 may be an ellipse.

What is claimed is:

1. A fuel injector comprising:

a cylindrical nozzle body;

a nozzle needle axially moving in the cylindrical nozzle body;

a pressure chamber defined between the nozzle needle and the cylindrical nozzle body for receiving a fuel therein; and an injection passage defined in the nozzle body to fluidly connect the pressure chamber and a cylinder of an internal combustion engine, wherein the fuel in the pressure chamber is injected into the cylinder as a fuel spray, the injection passage has a first hole which is opened to the pressure chamber and a second hole which is opened to the cylinder, an inner diameter of the second hole is larger than an inner diameter of the first hole, an outer periphery line of the fuel spray agrees with an inner wall of the second hole at a contact point, a minimum vertical distance between an outer periphery of a first nozzle hole outlet and the contact point relative to an axial center line of the first hole is defined as a vertical distance R, a minimum axial distance between the first nozzle hole outlet and the contact point relative to an axial center line of the first hole is defined as an axial distance L, an angle between the axial center line of the first nozzle hole and the outer periphery line of the fuel spray is defined as an injection angle θ, and the vertical distance R, the axial distance L and the injection angle θ satisfy a formula: $R/(L\times\tan\theta)>6.0$.

2. A fuel injector according to claim 1, wherein a pressure Pr of the fuel in the pressure chamber satisfies $25\ \text{Mpa}\leq Pr\leq 250\ \text{MPa}$.

3. A fuel injector according to claim 1, wherein the cylindrical nozzle body has a plurality of injection passages, and the second hole of each injection passage is not fluidly connected to other second holes.

4. A fuel injector according to claim 1, wherein the first hole has a nozzle hole inlet and a nozzle hole outlet, and an inner diameter of the nozzle hole inlet is equal to an inner diameter of the nozzle hole outlet.

5. A fuel injector according to claim 1, wherein the first hole has a nozzle hole inlet and a nozzle hole outlet, and an inner diameter of the nozzle hole inlet is larger than an inner diameter of the nozzle hole outlet.

6. A fuel injector according to claim 1, wherein the inner wall of the second hole is formed in parallel with the axial center line of the first hole.

7. A fuel injector according to claim 1, wherein an axial center line of the second hole deviates from the axial center line of the first hole.

* * * * *